US007246566B2

(12) United States Patent
Marion

(10) Patent No.: US 7,246,566 B2
(45) Date of Patent: Jul. 24, 2007

(54) COMBINATION SURFACE AND SUBMERSIBLE WATERCRAFT

(75) Inventor: Reynolds Marion, Lake Butler, FL (US)

(73) Assignee: Marion Hyper-Submersible Powerboat Design LLC, Lake Butler, FL (US)

( * ) Notice: Subject to any disclaimer, the term of this patent is extended or adjusted under 35 U.S.C. 154(b) by 403 days.

(21) Appl. No.: 10/722,621

(22) Filed: Nov. 26, 2003

(65) Prior Publication Data

US 2005/0166826 A1 Aug. 4, 2005

(51) Int. Cl.
*B63G 8/00* (2006.01)

(52) U.S. Cl. ..... 114/312

(58) Field of Classification Search ..... 114/66, 114/68, 312

See application file for complete search history.

(56) References Cited

U.S. PATENT DOCUMENTS

| | | | | |
|---|---|---|---|---|
| 1,510,283 | A | 9/1924 | Lake | |
| 1,864,837 | A | 6/1932 | Lake | |
| 2,337,318 | A | 12/1943 | Eliuk | |
| 3,038,431 | A | 6/1962 | Bajulaz | |
| 3,129,681 | A | 4/1964 | Bajulaz | |
| 3,257,982 | A | 6/1966 | Meldrum | |
| 3,598,074 | A | 8/1971 | Schubert | |
| 3,716,009 | A | 2/1973 | Strickland | |
| 4,458,618 | A * | 7/1984 | Tuffier | 114/68 |
| 4,494,472 | A * | 1/1985 | Rougerie | 114/66 |
| 4,676,545 | A * | 6/1987 | Bonfilio et al. | 296/193.04 |
| 4,745,860 | A | 5/1988 | Reymann et al. | |
| 4,889,066 | A * | 12/1989 | Neil et al. | 114/334 |
| 4,928,614 | A * | 5/1990 | Forman | 114/66 |
| 4,936,238 | A * | 6/1990 | Childress | 114/77 R |
| 5,542,240 | A | 8/1996 | Snider et al. | |
| 5,713,299 | A | 2/1998 | Lopez Ibor Alino et al. | |
| 5,787,836 | A * | 8/1998 | Blaisdell et al. | 114/357 |
| RE36,093 | E | 2/1999 | Wyman et al. | |
| 6,619,224 | B1 * | 9/2003 | Syfritt | 114/352 |
| 2003/0233971 | A1 * | 12/2003 | Belyeu | 114/347 |

FOREIGN PATENT DOCUMENTS

| | | |
|---|---|---|
| EP | 0716012 | 6/1996 |
| FR | 1399676 | 5/1965 |
| FR | 2648780 | 12/1990 |
| FR | 2688466 | 9/1993 |
| WO | WO 96/01207 | 1/1996 |
| WO | WO 99/52766 | 10/1999 |

OTHER PUBLICATIONS http://ussubs.com/submarines/manned.php3.
http://www.sub-find.com/mp26.htm.
http://www.subeo.com/history.htm.

* cited by examiner

*Primary Examiner*—Stephen Avila
(74) *Attorney, Agent, or Firm*—Saliwanchik, Lloyd & Saliwanchik

(57) ABSTRACT

A modular watercraft capable of both surface and submersible accommodation and transport of passengers. In one embodiment of the submersible watercraft of this invention, the hull comprises air bladders, thereby avoiding the engineering complexity, weight and cost of constructing a pressure hull.

27 Claims, 6 Drawing Sheets

COMBINATION SURFACE AND SUBMERSIBLE WATERCRAFT

FIELD OF THE INVENTION

A modular watercraft capable of both surface and submersible travel and accommodation and transport of passengers. Combination speedboat and submersible watercraft referred to herein as a "SuperCraft".

BACKGROUND OF THE INVENTION

There have been a number of efforts at producing watercrafts that have the ability to accommodate passengers safely above the water as well as below the surface of the water. For the most part, watercraft seeking to achieve this objective from the past have not been commercially viable at any reasonable cost. Accordingly, the need remains for a commercially viable watercraft for both surface and submersible travel and accommodation of passengers. This invention addresses that need by providing a modular watercraft which can operate as a conventional speedboat while on the surface of the water, and as a submarine, when deployed for travel below the water surface.

SUMMARY OF THE INVENTION

Figure 1:
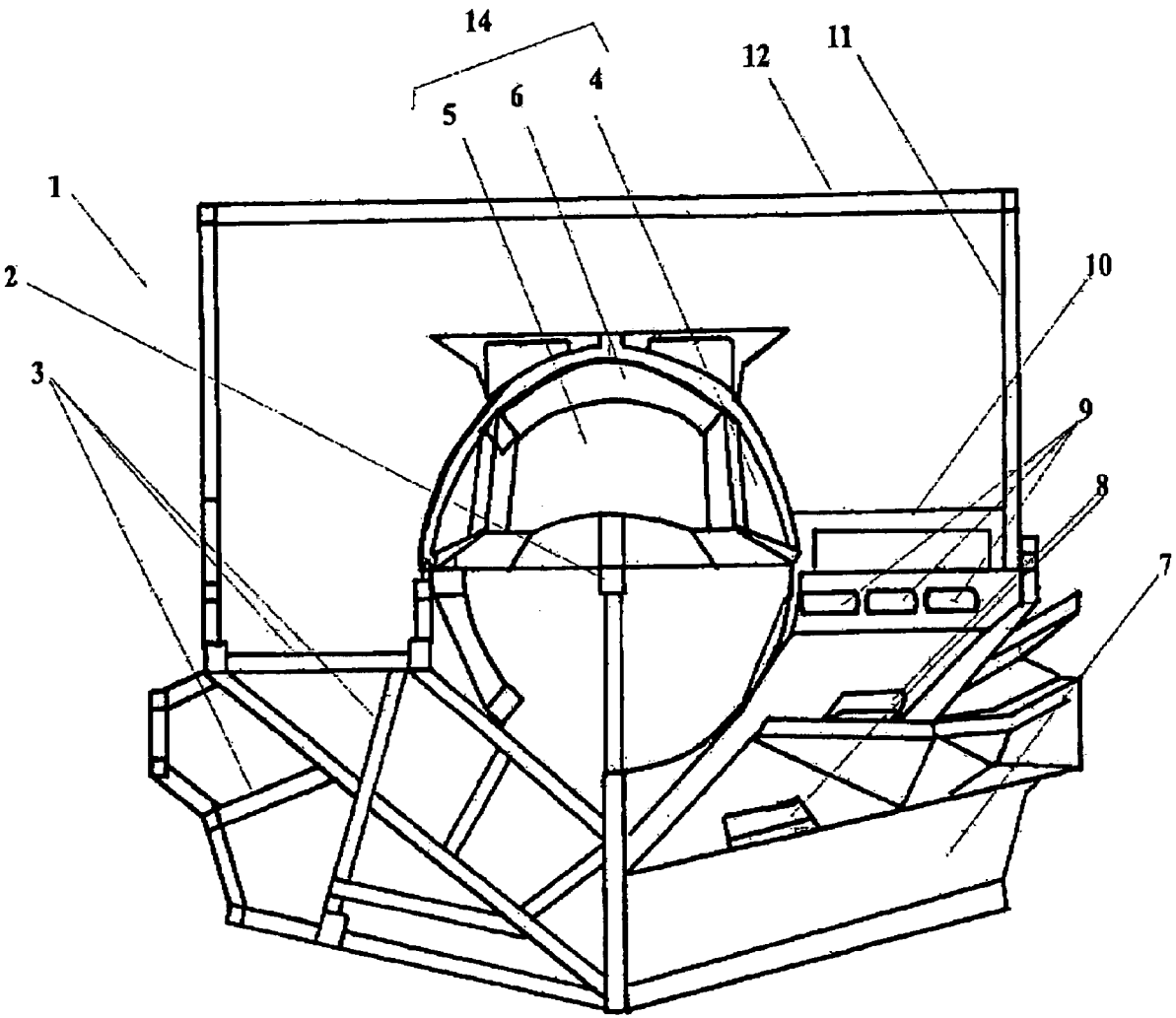
FIG. 1 shows a front view of one embodiment of the watercraft of this invention, with the left side of the figure showing the right front side of the watercraft with a section of the substructural support system shown; the right side of the figure shows the left front section of the SuperCraft with external features, including the craft's external "skin" intact.

A modular watercraft capable of both surface and submersible accommodation of passengers for recreational, tourism, military, research, or other purposes. The SuperCraft of this invention is designed to dive to depths of approximeately 150 feet for several hours at a time, and to accommodate surface travel in a model akin to a conventional speedboat.

DETAILED DESCRIPTION OF THE PREFERRED EMBODIMENTS OF THE INVENTION

This invention provides a commercially viable and mechanically simple to construct and manufacture watercraft capable of accommodating passengers for travel both on the surface and below the surface of water. The watercraft of this invention comprises a modular design including a hull compartment, an engine compartment and a passenger housing compartment. These modules may be separately manufactured and then anchored to each other, or may be built onto and into the hull compartment, as needed.

The modular watercraft is capable of convenient surface and submersible transport. In relative terms, the simplicity of the SuperCraft design provides for a commercially viable, production line capable watercraft which has the ability of conveniently accommodating passengers. In one embodiment, the modular design includes a hull, engine, and a separate passenger module.

In one embodiment of this invention, the hull comprises a hull compartment containing at least one air bladder which, when inflated, displaces water from within the hull, and which, when deflated, permits water to enter the hull compartment. Those of ordinary skill in the art, based on this disclosure, will appreciate that any system of valves known in the art for regulating gas containment and release may be used to inflate and deflate said air-bladders. The use of air bladders has the advantage that the hull compartment need not be gas-tight in order to achieve efficient water displacement. However, those skilled in the art will appreciate that a gas-tight hull may be utilized and simply filled with gas or water, depending on whether the watercraft is to submerge or remain on the surface.

In one embodiment of this invention, the hull contains at least one air bladder within the hull which is connected to a source of compressed gas such that the at least one air bladder may be inflated or deflated at the will of the operator. To induce the watercraft to surface, or for surface travel in general, the air bladder (or air-tight hull if such is utilized) is inflated. To submerge, the at least one air bladder is deflated (or if an air-tight hull is utilized, the hull is evacuated of air, and water is permitted to enter as ballast). Those of ordinary skill in the art will appreciate that more than one air bladder may be utilized, and, in fact, that it may be desirable to achieve water displacement from the hull using two or more air bladders. In one embodiment, the SuperCraft comprises four air bladders and/or four separate buoyancy tanks/cavities.

In a preferred embodiment of this invention, the submersible watercraft is amenable to surface transport as a conventional above-water surface watercraft, and depending on the power of the diesel or gas engines used, to operate in a mode akin to a conventional speedboat. The watercraft of this embodiment comprises a sealable, pressurizable passenger compartment, a hull, and an engine compartment. A significant engineering advantage of this embodiment is that the hull is not a pressure hull, but contains air-bladders by means of which water is expelled from the hull and by means of which watercraft buoyancy is controlled. Where a pressure hull is utilized, the cost, engineering complexity, and weight of the watercraft escalate rapidly. The present embodiment of this invention circumvents this difficulty by requiring only a pressurized passenger compartment while achieving watercraft buoyancy by means other than utilization of a pressure hull. The passenger compartment is the only component that is a pressure vessel limiting the weight and complexity of building such a craft. The cabin is a pressure vessel or pressure hull, meaning that it withstands outside pressure by the strength of its construction. Under normal circumstances, it is never pressurized. It remains at 14.7 psi due to the fact that it is so strong that it cannot compress, therefore, keeping the air inside from compressing.

The design of the passenger compartment allows for use of many redundant components. "Rolled" square tubing, a common, easy to obtain, inexpensive to produce common item may be used repeatedly in the construction of the passenger compartment (and, indeed, the hull infrastructure). Likewise for acrylic materials used in forming the passenger compartment viewing windows and passenger compartment superstructure. These components contribute to cost containment and commercial advantages in the manufacture of the SuperCraft.

Conventional materials that are durable and capable of containing gas to expel water from the hull of the watercraft are known.

Those skilled in the art will appreciate that a number of different solutions may be utilized for expelling water from the watercraft in order to induce the SuperCraft to rise to the water surface. In one embodiment of the watercraft of this invention, compressed gas resides within the hull compartment in a plurality of compressed gas tanks. By means of conventional solenoids, valves and gas plumbing, total control over the buoyancy state of the watercraft is achieved.

Preferably, the hull comprises a topside deck on which passengers can relax, fish, sunbathe or the like, when the watercraft is resident on the surface of the water. Furthermore, in a preferred embodiment of this invention, the hull design is streamlined and aerodynamic, providing for aesthetic appeal as well as minimized frictional drag both at the surface and when submerged. In addition, the entire watercraft, due to its substantially conventional hull design and contained weight, is trailerable.

In addition to the passenger compartment and hull compartment, the watercraft of this invention preferably comprises a separate engine compartment. In a preferred embodiment of this invention, the engine compartment permits water to enter up to a first height when said watercraft resides on the surface of a body of water, and which permits water to enter up to a second height when said watercraft is submerged, such that an equalization of internal and external pressure is achieved. Preferably, the first height and second height of water is controlled by a valve which shuts off at a predetermined water height within said engine compartment. In one embodiment, this is achieved by a valve which comprises a float which shuts off a conduit upon water forcing the float beyond a pre-determined shutoff point. Additionally, or alternatively, the engine compartment is pressurized by a source of compressed gas as needed to maintain parity between pressure within said engine compartment and water pressure external to said engine compartment.

The passenger compartment of the watercraft of this invention may take many forms without departing from the essential characteristics of this invention. In a preferred embodiment of this invention, the passenger compartment comprises a substantially tubular compartment. In one embodiment, the tubular passenger compartment is constructed from circular and semi-circular rings of perfectly rounded rolled square tubular steel. The passenger compartment of this invention may be opened and closed at will when on the water surface. When closed, the passenger compartment forms an air- and water-tight compartment. The passenger compartment is maintained at a constant one atmosphere of pressure (14.7 psi) by means of a source of compressed gas and conventional meters, solenoids, valves and gas plumbing, and the structural solidity of the cabin bulkhead. Those skilled in the art will further appreciate, based on this disclosure, that the source of compressed gas provides a stream of gas which not only maintains the closed passenger compartment at a constant one atmosphere of pressure, but which also replenishes the gas in the compartment so as to contain an optimal mixture of oxygen, nitrogen and other gasses, as needed, to ensure the safety and health of any living beings contained within the passenger compartment. In an emergency, air is introduced into the cabin. A carbon dioxide scrubber may be used and the passengers may breathe the pre-existing air. With a carbon dioxide scrubber, it is estimated that four people could breathe the same air for approximately four days without ever using any of the one thousand four hundred cubic feet stored in on-board compressed air tanks.

In a preferred embodiment, the passenger compartment comprises a non-deformable translucent material to form at least a portion of the walls of the compartment when the compartment is closed. In one preferred embodiment, the translucent material is Lucite capable of sustaining external pressure, when supported by an internal gas pressure of one atmosphere, equal to the maximum pressure anticipated to be encountered by the watercraft well beyond the pressure expected at the maximum submersion depth for the watercraft. In one embodiment, the Lucite is at least one to two inches thick. Preferably, viewing area is maximized and strength of the Lucite sections is maximized by inclusion of Lucite in the form of curved segments which form sealed portions of the walls of the substantially tubular passenger compartment. Preferably, the Lucite segments extend the viewing area of each passenger of the watercraft by providing a shoulder-to-shoulder canopy of translucent passenger compartment wall surrounding each passenger.

Preferably, the SuperCraft utilizes clear acrylic to comprise over 48% of the passenger compartment superstructure. By utilizing the strength of Plexyglass or like acrylic translucent material as a primary component in the construction of the pressurized passenger compartment, passengers are provided with unprecedented visibility while limiting the overall weight of the craft. In addition, the shape and size of the acrylic is redundant, adding to the ease of manufacturing of the SuperCraft's and aesthetic appeal necessary for a commercially viable design.

Preferably, the passenger compartment is replenished with breathable air each time the watercraft surfaces by means of an on-board breathing compressor.

For locomotion, preferably the watercraft comprises at least one diesel or gas motor for above-water propulsion and an electric motor for submerged propulsion. In one embodiment, a preferred motor for powering the watercraft on the surface is at least one and preferably two 425 HP Crusader V8 motors, disposed at the rear end of the SuperCraft. When submerged, at least one, and preferably a plurality of electric motor(s) power a propeller.

In one embodiment of the watercraft of this invention, the total mass of the watercraft is between four and eight tons, and is preferably about six to eight tons, and most preferably, about 15,000 pounds. In this embodiment, the watercraft comprises a ballast of about one to four tons, and preferably about two to three tons. Preferably, a ballast of about 3,000 pounds is automatically released from the watercraft if a depth below a preset limit is reached, thereby causing said watercraft to immediately ascend to the water surface. This feature of the watercraft of this invention is referred to as the "quick-flight" feature and it represents a significant safety advantage to the field of submersible watercrafts generally. The "quick-flight" feature kicks in if the SuperCraft goes too deep, if it registers a sudden spike in cabin pressure or if the carbon dioxide content is determined to be approaching unacceptable pre-set tolerances.

In one embodiment, the submersible of this invention comprises a passenger compartment that accommodates between one and eight passengers, and preferably up to four passengers in an air-conditioned, preferably deluxe (optionally including visual and auditory entertainment features) space. Preferably, the cabin (passenger compartment), engine compartment, and hull are three separate modules, which are brought together in a central chassis formed by the hull compartment which acts as the buoyancy module.

In one embodiment of this invention, the SuperCraft comprises four ballast tanks/airbags. To control pitch and roll, in operation, before diving, the operator of the SuperCraft utilizes the four ballast tanks/air bags (two forward, left and right, two in the rear, left and right) to level the craft. If the craft is leaning forward, the operator lets some air out of the rear bags. If it is leaning to the right or left, then the operator lets air out of the right or left two bags as needed, to level the craft.

To dive, the operator activates appropriate valves (tied to all of the bags) and releases air until neutral buoyancy is achieved. At this point, the operator deploys and tilts diving planes, on either side of the watercraft, downward. The diving planes are protected under the "sunbathing" deck when the watercraft is operated on the surface. They are hinged to the outermost edge of the deck immediately to the left and right of the driver. Once deployed, they stick out an additional approximately three feet on either side of the craft.

Due to their forward location, once engaged, the "forward thrusters", with a down plane angle, and the force of the water pressing down on the diving planes, the nose of the craft is pushed down as well. Given the shape of the SuperCraft, it, in and of itself, forms a huge diving plane. Therefore, very little pressure applied to the diving planes is required to cause the SuperCraft to be pushed forward and downward.

As approximately ninety-five percent of the vehicle mass is located below centerline, very little if any roll is encountered by the SuperCraft, and it has the propensity to "right" itself immediately. The airbag/ballast system can also be used to control the vehicles' "trim" while running on the surface, potentially adding to surface performance. If the operator is not satisfied with the vehicle "plane" then the front and rear displacement of the vehicle is simply modified to lower or raise the rear end!

Having generally and specifically described preferred embodiments of this invention, reference is now made to the figures provided herewith to supplement the written description of the invention. While preferred design elements and specifics are provided in the attached diagrams for one embodiment of the SuperCraft of this invention, these specifics should be considered exemplary and illustrative, rather than limiting.

FIG. 1 shows a front view of one embodiment of the watercraft of this invention, with the left side of the figure showing the right front side of the watercraft with a section of the substructural support system shown; the right side of the figure shows the left front section of the SuperCraft with external features, including the craft's external "skin" intact. Like elements are identified with like numerals in the several figures. The SuperCraft 1 itself is shown end-on from a front view. The nose 2 of the craft is the frontmost point of the hull, providing a wedge for cutting through the water. The internal structural support 3 of the SuperCraft is shown in the left side of this figure. Composite carbon fiber, welded metal, or like structural components may be used to provide the infrastructure for the SuperCraft. Side 4, front 5, and top 6 Lucite viewing ports provide the structural components completing the upper portion of the passenger cabin 14. The lower portion of the SuperCraft forms a conventional speedboat like hull 7 with stairs 8 provided for mounting to the upper left side deck 10. Lights 9 are provided for night-time and submerged travel safety, convenience, and viewing pleasure. A side support 11 affixes an airfoil 12 to the SuperCraft body.

Figure 2:
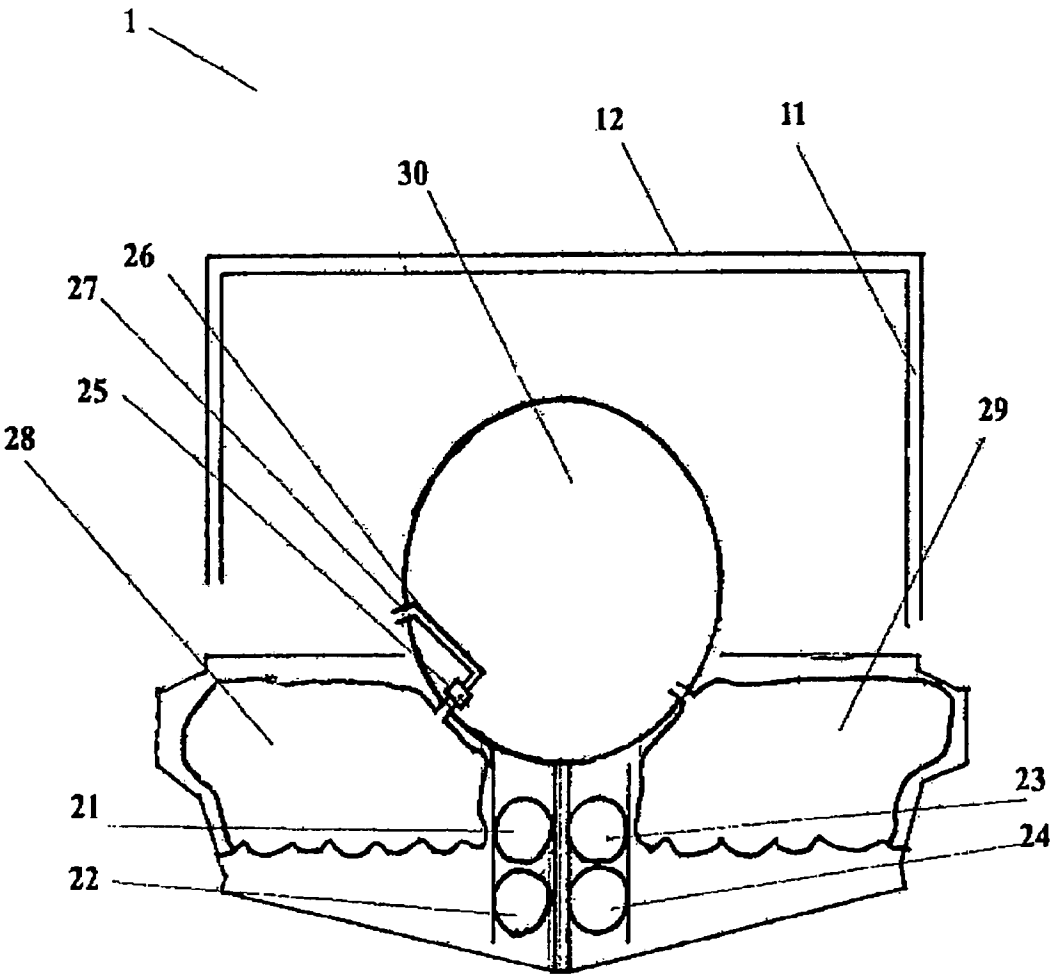
FIG. 2 shows a transverse cross-sectional view through the passenger compartment and hull compartment of the watercraft of this invention.

FIG. 2 shows a transverse cross-sectional view through the passenger compartment and hull compartment of the watercraft of this invention. In addition to those elements shown in FIG. 1, this figure shows four compressed gas tanks 21, 22, 23, 24. These gas tanks are utilized to port air to the air bags, 28, 29, 41, 60 (see FIG. 6 for the latter two elements), and to provide breathable air to the passenger compartment 30. Air flow into and out of the air bags is controlled by a valve 25 which is connected to a hose 26 and exhaust port 27.

Figure 3:
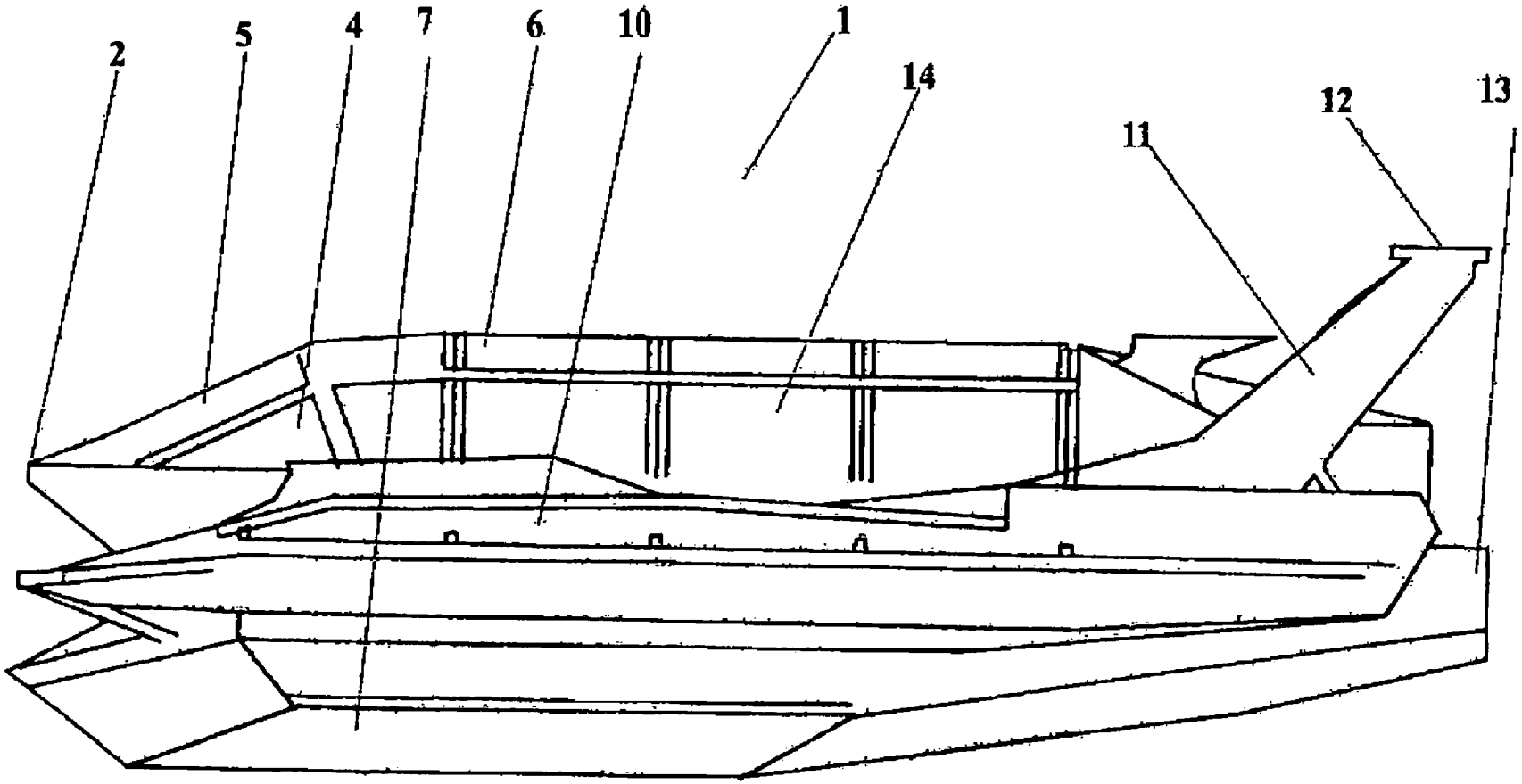
FIG. 3 shows a left side external view of the SuperCraft.

FIG. 3 shows a left side external view of the SuperCraft, with elements as described above, except for the rear of the craft 13 and the passenger compartment exterior 14.

Figure 4:
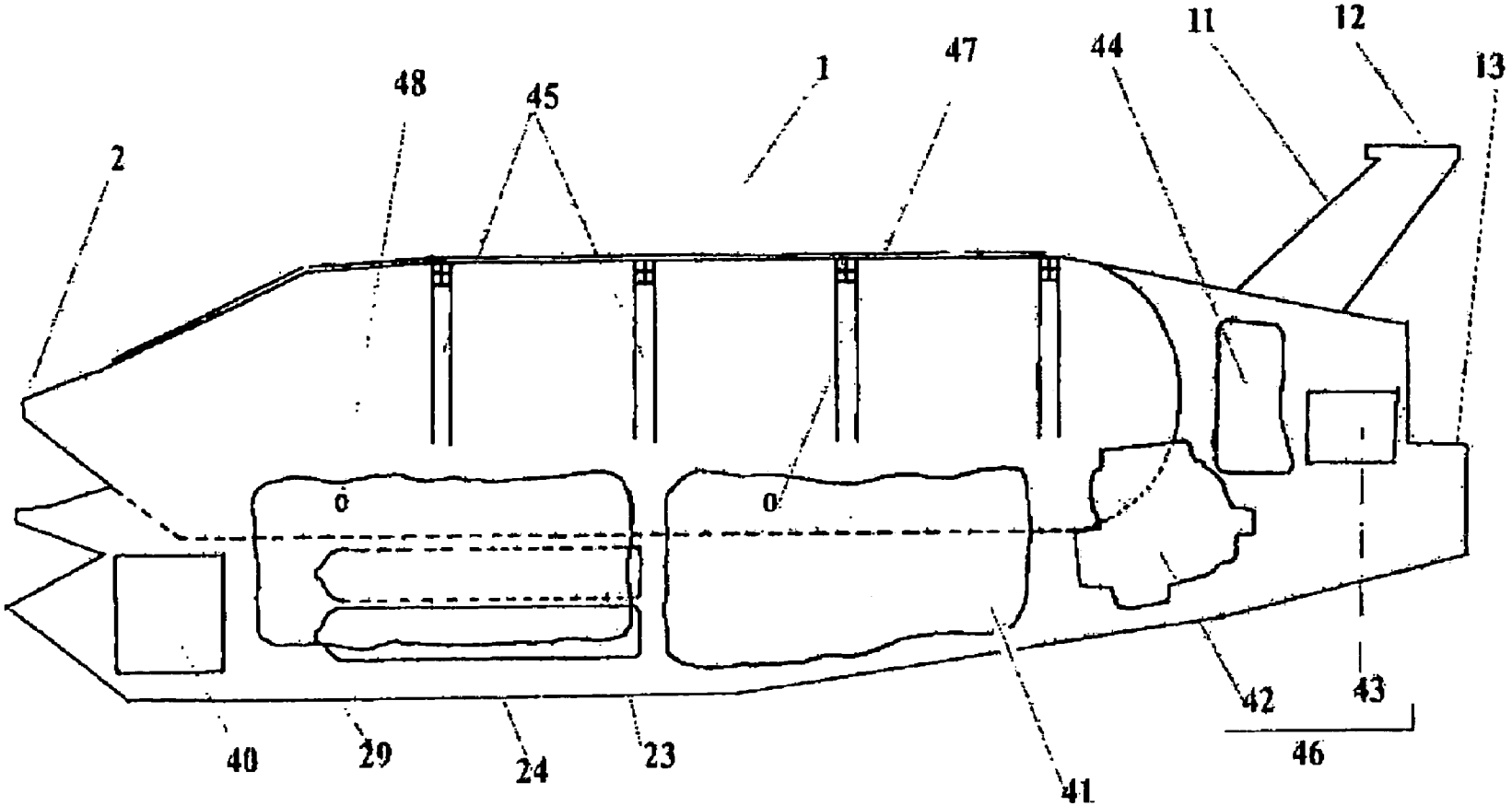
FIG. 4 shows a longitudinal cross-sectional view through the long axis of the watercraft of this invention, including the hull compartment, passenger compartment, and engine compartment.

FIG. 4 shows a longitudinal cross-sectional view through the long axis of the watercraft of this invention, including the hull compartment, passenger compartment, and engine compartment. Additional elements shown in this figure include the rear left air bag 41, the air pipe inlet and exhaust vents 47, 48 for the left rear air bag 41 and left front air bag 29, respectively. The left side diesel or gas engine 42 is shown, as is an electric motor 43 including batteries for submersed torque, which together form the engine compartment 46. An air compressor 44 is included for breathing air. A cutaway shows the bulkhead 45 formed from rolled tubing. The "quick-flight" ballast 40 is show in the forward compartment, ready to be released as needed. The rear compartment 13 utilizes exterior water pressure to support the wall structure of the engine compartment 46.

Figure 5:
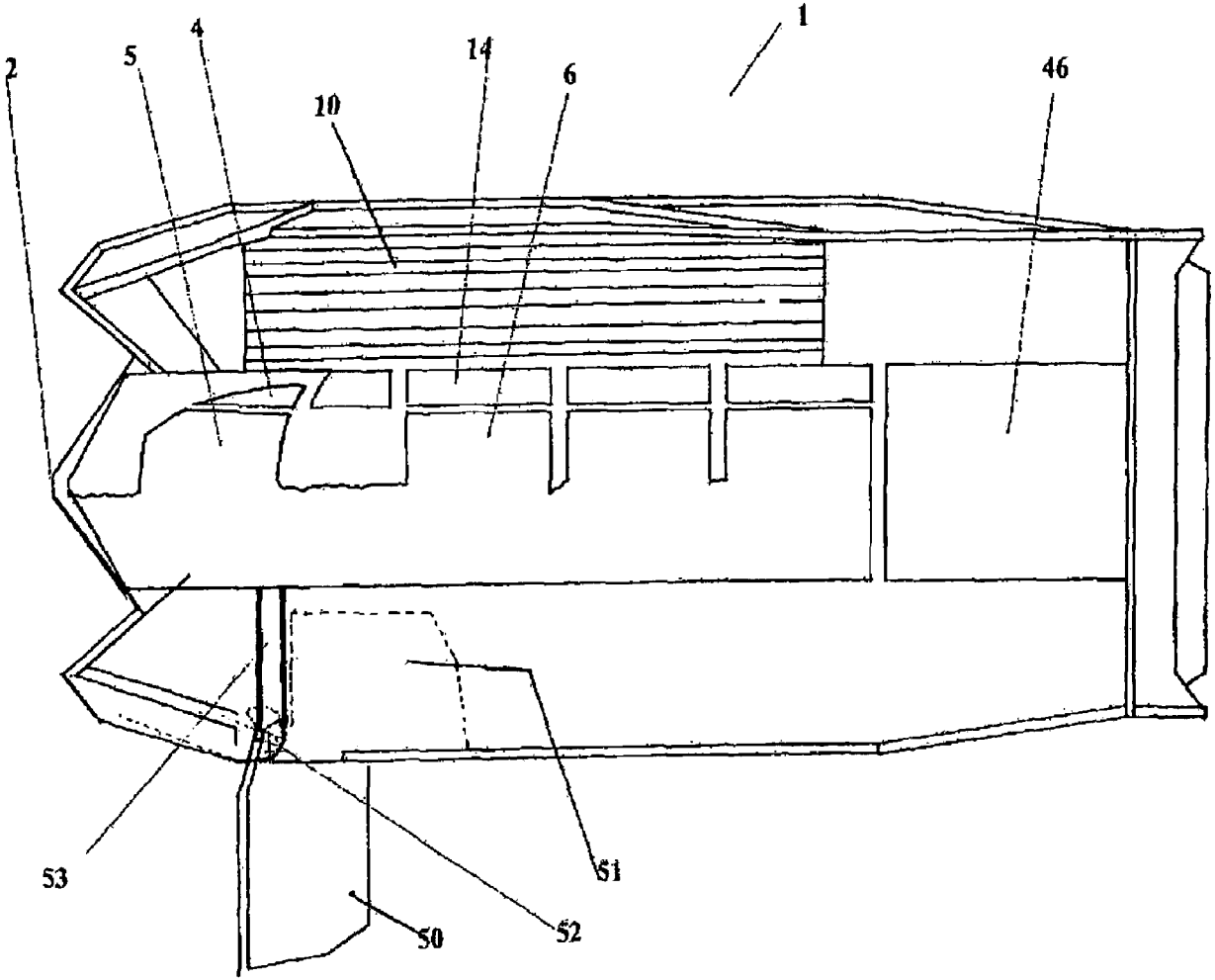
FIG. 5 shows a top plan view of the watercraft of this invention, with the upper portion of the figure showing the external appearance of one embodiment of the invention; the lower half of the figure shows a cut-away section, revealing the diving plane both in an extended and, in outline, in a retracted position.

FIG. 5 shows a top plan view of the watercraft of this invention, with the upper portion of the figure showing the external appearance of one embodiment of the invention; the lower half of the figure shows a cut-away section, revealing the diving plane both in an extended 50, and in outline, in a retracted position 51. The diving plane is driven to its extended and retracted positions via a gear 52 and a motorized drive shaft 53.

Figure 6:
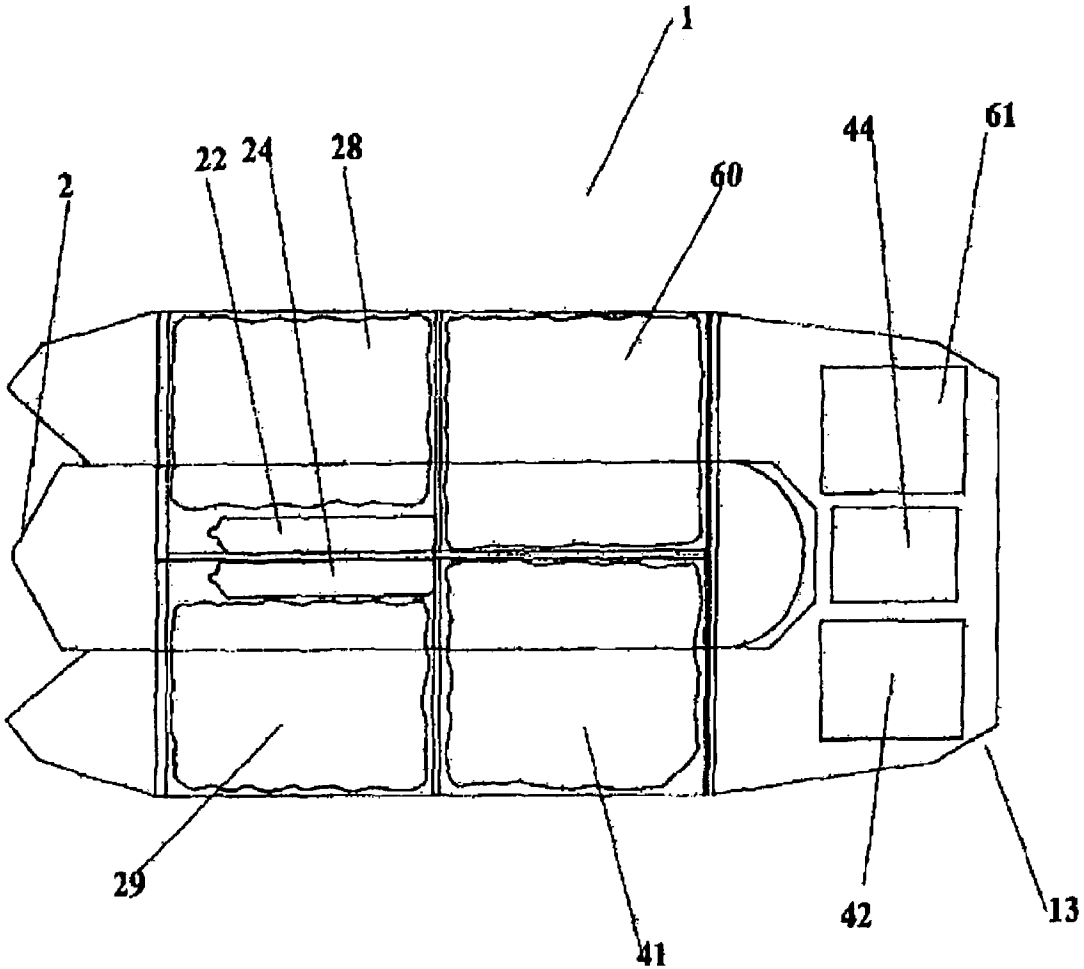
FIG. 6 shows a top plan view of a section transversely through the middle of the watercraft of this invention.

FIG. 6 shows a top plan view of a section transversely through the middle of the watercraft of this invention. All elements shown are described above, except for the right rear diesel or gas engine, 61, and the right rear air bag 60.

Having generally and specifically described the SuperCraft of this invention, including the method of making and using the SuperCraft, and the best mode thereof, the following claims are provided to define that which the inventor considers to be his invention, which are considered to include equivalents and obvious variants of this invention.

What is claimed is:

1. A watercraft capable of accommodating passengers for travel both on the surface and below the surface of water comprising a modular design including a hull module and a passenger housing module, wherein the hull module includes a V-shaped speedboat-like hull and wherein the passenger housing module is a pressure vessel.

2. The watercraft according to claim 1 wherein said hull module includes at least one air bladder which, when inflated, displaces water from a compartment within the hull, and which, when deflated, permits water to enter the hull compartment.

3. The watercraft according to claim 2 wherein said at least one air bladder within said hull compartment is connected to a source of compressed gas such that said at least one air bladder may be inflated or deflated at will to induce the watercraft to surface when said at least one air bladder is inflated and to submerge when said at least one air bladder is deflated.

4. The watereraft according to claim 3 wherein said compressed gas resides within said hull module in a plurality of compressed gas tanks.

5. The watercraft according to claim 2 comprising four air bladders.

6. The watercraft according to claim 5 wherein said watercraft is induced to submerge by deflating said air bladders and to ascend for surface travel by inflating said air bladders.

7. The watercraft according to claim 1 wherein said hull module includes a sealed compartment which may be filled with air or water at will.

8. The watercraft according to claim 1 further comprising an engine module.

9. A watercraft capable of accommodating passengers for travel both on the surface and below the surface of water, the watercraft comprising a hull module, a passenger housing module, and an engine module, wherein said engine module permits water to enter up to a first height when said watercraft resides on the surface of a body of water, and which permits water to enter up to a second height when said watercraft is submerged, such that an equalization of internal and external pressure is achieved.

10. The watercraft according to claim 9 wherein said first height and said second height of water is controlled by a valve which shuts off at a predetermined water height within said engine module.

11. The watercraft according to claim 10 wherein said valve comprises a float.

12. The watercraft according to claim 11 wherein said float shuts off when water entering said engine module reaches a predetermined height, and wherein said engine module is pressurized by a source of compressed gas as needed to maintain parity between pressure within said engine module and water pressure external to said engine module.

13. The watercraft according to claim 1 wherein said passenger housing module comprises a substantially tubular passenger compartment.

14. The watercraft according to claim 13 wherein said substantially tubular passenger compartment may be opened and closed at will, but which, when closed, forms an air- and water-tight compartment.

15. The watercraft according to claim 14 wherein said substantially tubular passenger compartment when closed is maintained at a constant one atmosphere (14.7 psi) of pressure by means of a source of compressed gas and the structural support provided for the passenger compartment.

16. The watercraft according to claim 15 wherein said source of compressed gas provides a stream of gas which not only maintains said compartment at a constant one atmosphere of pressure, but which also replenishes the gas in said compartment so as to contain an optimal mixture of oxygen, nitrogen and other gasses, as needed, to ensure the safety and health of any living beings contained within said passenger compartment.

17. The watercraft according to claim 16 wherein said compartment comprises a non-deformable translucent material to form at least a portion of the walls of said compartment when said compartment is closed.

18. The watercraft according to claim 17 wherein said translucent material is a translucent acrylic material.

19. The watercraft according to claim 18 wherein said translucent acrylic material is plexiglass or other similar translucent plastic.

20. The watercraft according to claim 18 wherein said translucent acrylic material is capable of sustaining external pressure, when supported by an internal gas pressure of one atmosphere, equal to the maximum pressure anticipated to be encountered by said watercraft well beyond the pressure expected at the maximum submersion depth for said watercraft.

21. The watercraft according to claim 20 wherein said translucent acrylic material is at least one inch thick.

22. The watercraft according to claim 21 wherein said translucent acrylic material is in the form of curved segments which form sealed portions of the walls of said substantially tubular passenger compartment.

23. The watercraft according to claim 1 further comprising at least one diesel or gas motor for above-water surface propulsion of said watercraft.

24. The watercraft according to claim 23 further comprising at least one electric motor for submerged propulsion of said watercraft.

25. The watercraft according to claim 1 comprising a total mass of approximately 15,000 pounds.

26. The watercraft according to claim 25 comprising a ballast of water, and comprising an added emergency release ballast weighing approximately 3,000 pounds.

27. The watercraft according to claim 26 wherein said release ballast is automatically released from said watercraft if a depth below a preset limit, or a carbon dioxide content in the passenger compartment above a pre-determined tolerance is reached, thereby causing said watercraft to immediately ascend to the water surface.

* * * * *